US005775160A

United States Patent [19]

Fleischer et al.

[11] Patent Number: 5,775,160

[45] Date of Patent: Jul. 7, 1998

[54] REDRAW MECHANISM FOR CAN BODY MAKER APPARATUS

[75] Inventors: Karl S. Fleischer, Denver; Behzad Bakhti-Suroosh, Evergreen, both of Colo.

[73] Assignee: Aluminum Company of America, Pittsburgh, Pa.

[21] Appl. No.: 846,745

[22] Filed: Apr. 30, 1997

Related U.S. Application Data

[60] Provisional application No. 60/018,850 May 31, 1996.

[51] Int. Cl.[6] ..... B21D 24/04

[52] U.S. Cl. ..... 72/349; 72/350

[58] Field of Search ..... 72/347, 349, 350, 72/452.3, 452.6, 430

[56] References Cited

U.S. PATENT DOCUMENTS

| | | | |
|---|---|---|---|
| 3,289,453 | 12/1966 | Wyle et al. | 72/349 |
| 3,696,659 | 10/1972 | Lawford | 73/4 R |
| 3,735,629 | 5/1973 | Paramonoff | 72/349 |
| 4,912,343 | 3/1990 | Stuart | 310/14 |
| 4,934,169 | 6/1990 | Sjogren | 72/385 |
| 5,187,398 | 2/1993 | Stuart et al. | 310/14 |
| 5,212,977 | 5/1993 | Stuart | 72/347 |
| 5,257,523 | 11/1993 | Hahn et al. | 72/349 |
| 5,271,259 | 12/1993 | Miller et al. | 72/349 |
| 5,307,665 | 5/1994 | Stuart | 72/347 |
| 5,325,699 | 7/1994 | Stuart | 72/347 |
| 5,357,779 | 10/1994 | Hahn et al. | 72/347 |
| 5,454,252 | 10/1995 | Mueller | 72/349 |
| 5,454,253 | 10/1995 | Mueller | 72/349 |
| 5,454,254 | 10/1995 | Mueller | 72/349 |

*Primary Examiner*—Lowell A. Larson
*Attorney, Agent, or Firm*—Thomas R. Trempus

[57] ABSTRACT

An improved can body maker apparatus has a redraw system of reduced mass. An air actuator is incorporated into the redraw motion assembly to maintain a cam actuated arm in contact with a cam surface during the reform cycle. A improved mechanical linkage eliminates the conventional redraw carriage. The redraw sleeve is supported within a fluid bearing mounted in a stationary housing.

20 Claims, 5 Drawing Sheets

REDRAW MECHANISM FOR CAN BODY MAKER APPARATUS

This application claims the benefit of the prior filed, copending U.S. Provisional Patent application Ser. No. 60/018,850, filed May 31, 1996.

FIELD OF THE INVENTION

This invention relates generally to can body makers and more particularly to the redraw system of a can body maker. The improved redraw system includes a mechanically reciprocated redraw sleeve that captures the cup prior to the drawing and ironing process. An electromagnetic system generates the hold down force during drawing and ironing.

BACKGROUND OF THE INVENTION

A conventional can body maker apparatus is disclosed in U.S. Pat. No. 3,696,659, issued to J. H. Maytag and an improvement to the ram assembly of the can body maker ram assembly is disclosed in U.S. Pat. No. 4,934,169, issued to C. M. Grimes, et al. Both of these patents are assigned to Adolph Coors Company. An example of a conventional redraw system is also described in U.S. Pat. No. 3,735,629, issued to Elpidofor Paramonoff, and assigned to Standun Inc. The aforedescribed patents are incorporated herein by reference as if fully set forth herein. The assignee of the instant invention is also the assignee of U.S. Pat. No. 5,454,252, "Can Body Maker Apparatus with Flexible Redraw Sleeve"; U.S. Pat. No. 5,454,253, "Redraw Mechanism for Can Body Maker Apparatus"; and U.S. Pat. No. 5,454,254, "Can Body Maker Apparatus with Air Actuator Redraw Mechanism".

Can body makers produce elongated can bodies from shallow metal cups or can shells. The can shells have a wall thickness of approximately 0.009 to 0.012 inch, and the elongated can bodies have a wall thickness reduced to approximately 0.0045 inch. In a conventional can body maker apparatus, a ram is movably mounted for reciprocal, straight line motion at rates sufficient to form between 180 and 220 can bodies per minute. It goes without saying that misalignment as small as about 0.0005 and 0.0010 inch can result in the formation of defective cans. In conjunction with the reciprocal motion of the ram, a redraw sleeve is supported for reciprocal motion in a redraw assembly. The redraw sleeve engages the shell prior to the ram contacting the shell, applying a restraining force against the shell as it is worked in a redraw die. The redraw process elongates the sidewalls of the can shell and decreases the sidewall thickness and overall diameter of the can shell. The redraw operation is followed by two or three ironing stations that further elongate and thin the walls of the can shell to form a one piece can body. Finally, the body maker can be equipped with a doming station that further forms the enclosed bottom of the can body into a desired structural configuration.

The redraw assembly operates at the same rate of reciprocation as the ram assembly. It has been the practice to provide mechanical linkage between the main crank shaft of the can body maker and both the ram assembly and the redraw assembly. In order to minimize the potential for misalignment, in conventional body makers, the redraw sleeve carriage is supported on a track way that is parallel with the ram assembly. Needless to say, a significant amount of mass is being reciprocated in the redraw carriage assembly and this mass can contribute to the misalignment problem mentioned above. An alternative approach to such a mechanical linkage system is the application of electromagnetic technology to the redraw actuator of container bodymakers. Examples of such an application are found in the following U.S. Patents, the contents of which are incorporated herein as if fully set forth, U.S. Pat. Nos. 5,212,977; 4,912,343; 5,187,398; 5,271,259; and 5,257,523.

Nevertheless, there remains a ongoing desire in the can making industry to increase the speed at which can body makers operate, for example, it is a goal of the industry to achieve production rates or over 400, and even 500, can bodies per minute from an individual can body maker apparatus.

SUMMARY OF THE INVENTION

According to this invention, an improved redraw system for a can body maker system includes a redraw housing means adapted to be fixedly mounted onto a body maker, and through which the ram reciprocates. The redraw housing means has a forward face proximate the body maker toolpack and a rearward face opposite thereto. The forward face includes an electromagnetic means mounted therein. Cam support means is mounted for rotational movement within the redraw housing means. The cam support means is a cylinder including an inner face and an outer face. The outer face includes gear means in communication with motive means for imparting rotational movement to the cam support means within the redraw housing means. The inner face of the cam support means includes an internal cam extending radially inwardly from the cylindrical surface. A core means is mounted within the ram support means for reciprocal motion within the redraw housing means. The core means has a forward face on which is supported a ferrous core member onto which can be attached a redraw sleeve. The movable core means includes cam follower means in operative communication with the internal cam means. As the cam support means rotates within the housing, the cam causes the reciprocal motion of the movable core means.

The internal cam means includes a forward cam face and a rearward cam face that interact with the cam followers supported on the movable core. Through a first portion of one complete revolution of the cam support means, the forward cam face urges the movable core toward the forward face of the redraw housing. At the closest point of approach of the movable core to the forward face of the redraw housing, the configuration of the cam is such that a dwell cycle is initiated and the redraw sleeve contacts and engages the cup that is to be drawn and ironed. During the dwell cycle, the electromagnetic means is activated so as to urge the movable cam forward into a hold down position in which up to 5000 pounds of hold down force is applied by the redraw sleeve. The hold down force grips the cup between the redraw sleeve and the toolpack. The ram then drives into the cup, initiating the drawing and ironing process by which the can body is formed. During the dwell cycle, the cam support means continues to rotate within the housing. Upon completion of the dwell cycle, the rotation of the cam support means causes the cam to initiate the withdrawal of the movable core and attached redraw sleeve from the toolpack. At the most distant point of travel from the toolpack, the movable core may enter another dwell cycle. During retraction of the redraw sleeve, the optional dwell cycle of the movable core, and subsequent approach of the movable core towards the toolpack, a formed can body is removed from the toolpack and a new cup is positioned for drawing and ironing.

It is an object of this invention to provide an improved redraw system for use in a can body maker apparatus.

It is also an object of this invention to eliminate the conventional air spring/ air cylinder system, redraw carriages, and fluid bearings that typically are employed in a conventional redraw system.

It is again an object of this invention to provide an improved redraw system capable of increased redraw pressure selectability and improved cycle time.

It is yet another object of this invention to provide an improved structure for the support and alignment of a redraw sleeve while minimizing the amount of mass being reciprocated in conjunction with the redraw operation.

It is also an object of this invention to provide a redraw system that can be retrofitted into existing can maker systems.

BRIEF DESCRIPTION OF THE DRAWINGS

The above as well as other features and advantages of the invention can be more fully appreciated through consideration of the detailed description of the invention in conjunction with the several drawings in which.

DETAILED DESCRIPTION OF A PREFERRED EMBODIMENT

Figure 1:
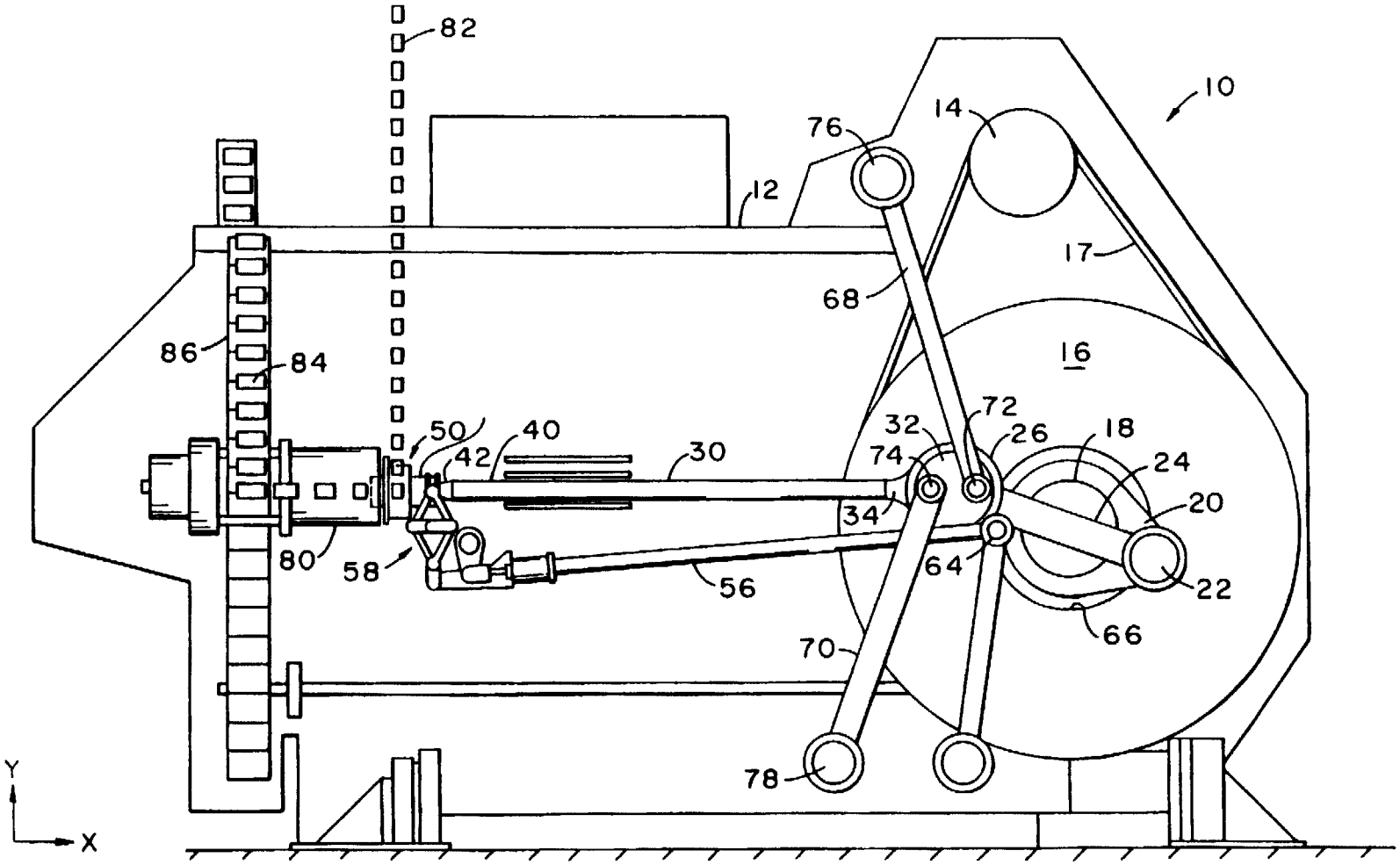
FIG. 1 (PRIOR ART)
FIG. 1 is an somewhat diagrammatic view of a prior art can body maker apparatus.
Figure 2:
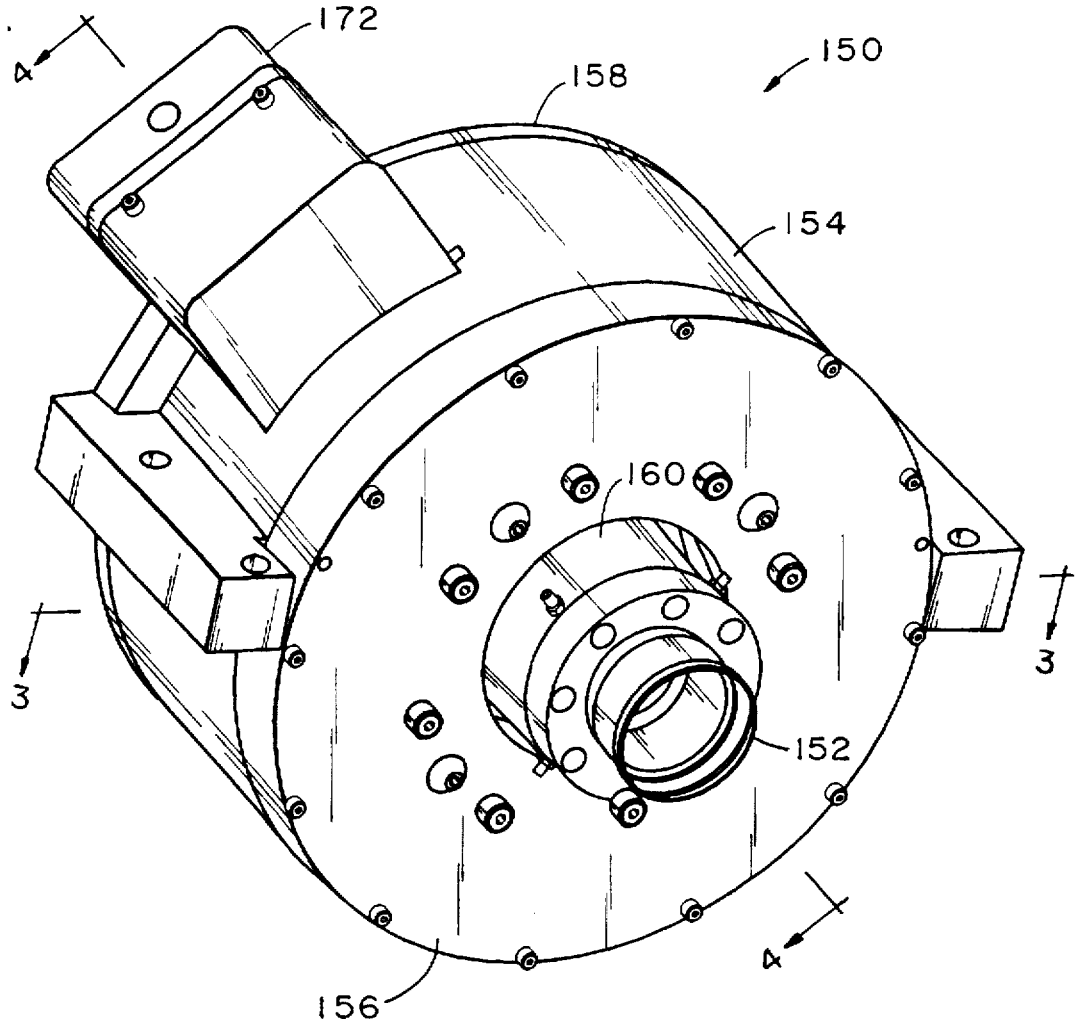
FIG. 2 is an isometric view of the redraw system of the instant invention.

In order to fully appreciate the various aspects of this invention, it is critical to understand certain fundamental features of a typical can body maker apparatus. Turning now to FIG. 1, a can body maker is generally indicated by the reference character 10. The can body maker 10 includes a frame or housing structure 12 having mounted thereon a motor 14 that drives a large pulley wheel 16 by belt 17. The pulley wheel 16 is fixedly mounted on one of a pair of transversely extending axially aligned crankshafts 18 with crank arms 20. The crankshafts 18 are rotatable in bearings mounted in opposed sides of the frame 12. The crank arms 20 are connected together by a crank pin 22 extending through the bearings of a main connecting rod 24 which terminates at its other end in two parallel transversely spaced apart arms for engaging the circumferential surfaces of a cross head member 26, which is part of the straight line motion assembly generally designated by the reference character 30. The pivotal point of the assembly is designated 32. The cross head member 26 is engaged circumferentially by the end of a carriage connecting rod 34 by the connecting rod 24. The carriage connecting rod 34 is pivotably connected at its other end to a ram assembly 40, in which is mounted a ram or punch generally indicated at 42.

The ram or straight line motion assembly 40 includes a side thrust resisting, upper swing lever 68 and lower swing lever 70, both bifurcated at their inner ends so as to straddle the cross head member 26. The upper swing lever 68 is pivotably connected to the cross head member 26, as indicated at 72, and the lower swing lever 70 is pivotably connected at 74 to the cross head member 26. The upper end of the upper swing lever 68 is pivotably connected to the fixed pivots 76 on frame members 12, and the lower end of the lower swing lever 70 is pivotably connected to the fixed pivots 78 on frame members 12.

A redraw sleeve supporting assembly generally indicated at 50 is located adjacent a toolpack housing 80. A redraw sleeve 52 travels along an axis that is parallel to the ram 42 and movable in longitudinal or X axis motion independently of the ram. The toolpack housing 80, mounted in the front, or left hand portion of the can body maker as illustrated in FIG. 1, encloses a series of drawing and ironing dies (not shown) through which a work piece such as a shallow cup 82 is worked by the ram in combination with the redraw assembly 50. The cup 82 is drawn and ironed into a can body 84 and a suitable transport system 86 conveys the can body 84 from the body maker 10 for further processing. The redraw operation is the most critical function in the can making process. The redraw assembly 50 is located in front of the ram assembly 30 and next to the die housing assembly 80. The redraw assembly 50 performs the redraw operation and provides the alignment structure for the redraw sleeve 52. Generally, the redraw sleeve 52 aligns the metal cup 82 during the redraw operation and provides the correct pressure to the metal cup holding it against the redraw die face of the toolpack 80.

Considering FIGS. 2 through 6, the improved redraw system 150 of this invention supports a redraw sleeve 152 in a support housing generally indicated at 154. The redraw sleeve reciprocates in the support housing along an X axis. The reciprocal movement is relative to the forward portion of the ram. The independent movement of the redraw sleeve assembly occurs in conjunction with and in a timed fashioned with respect to the motion of the ram assembly. The redraw system 150 is fixedly mounted to the frame of the bodymaker, proximate the toolpack.

Figure 3:
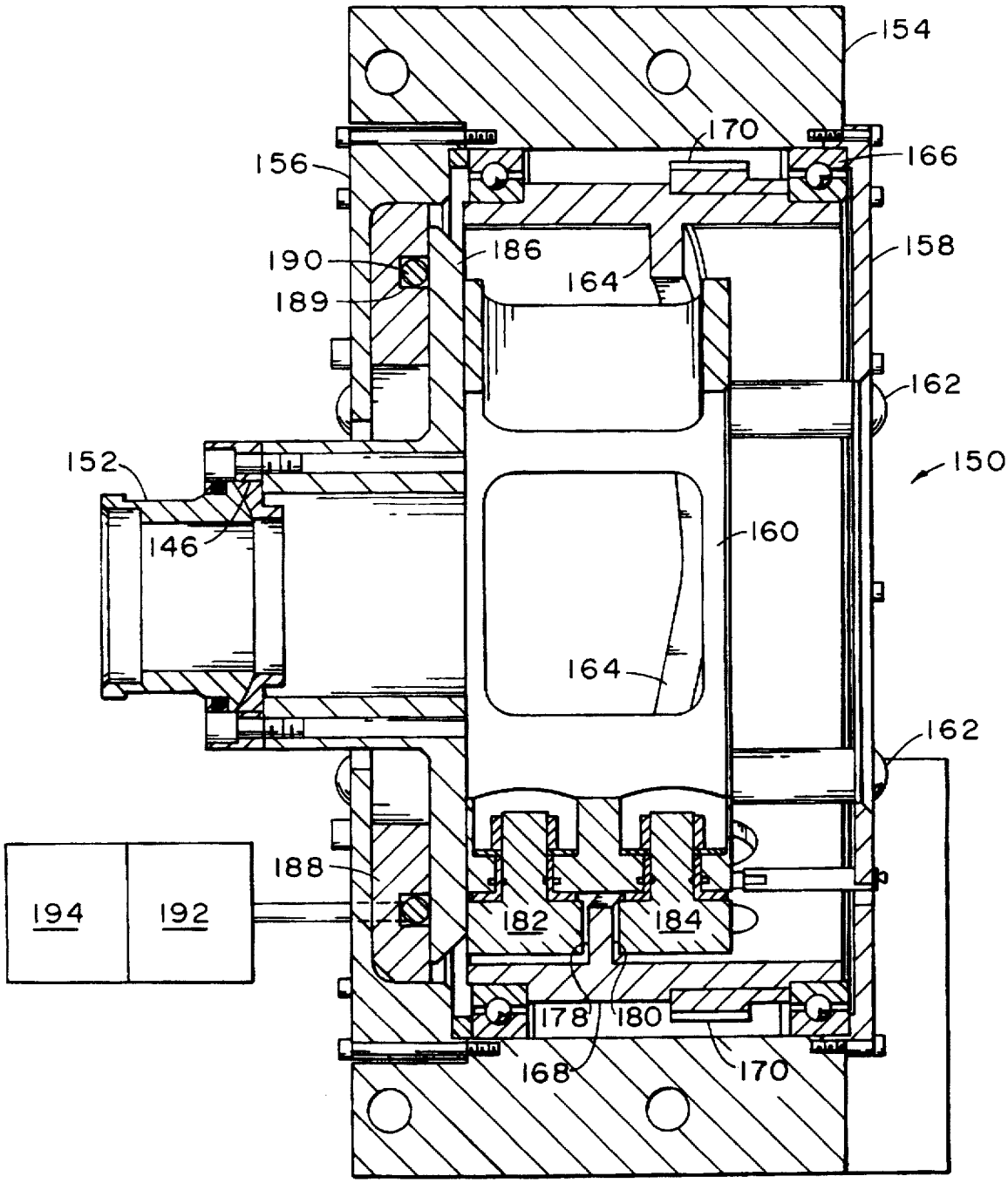
FIG. 3 is an isometric view in section of the redraw system of the instant invention shown in its forward position.

The redraw sleeve supporting assembly 150 includes a housing 154 that has a front face 156 and a rear face 158. It is to be understood that by front or forward it is meant that portion of the assembly 150 proximate the toolpack housing 80. A moving core 160 is supported for reciprocal movement within the housing 154. The core 160 is supported by a plurality of shaft members indicated at the reference characters 162 (FIG. 3). Preferably, there are four such shaft members 162 extending through the housing 154 and supported by the front and rear faces 156 and 158 of the housing. Also supported within the housing 154 and forming a part of the assembly 150 is the redraw cam 164 (FIG. 3). The redraw cam 164 includes a cylindrical-like member that surrounds the moveable core 160. The cylindrical cam 164 is supported by a plurality of bearings as at 166. The outside diameter surface 168 of the cylindrical cam 164 includes a toothed surface as at 170. A motive means schematically represented at 172 (FIG. 4) is in mechanical communication with a bull gear 174 (FIG. 4) that is in mechanical communication with the gear teeth 170 on the outer diameter 168 of the cylindrical cam 164. Rotation of the bull gear by the motive means causes the cylindrical cam to rotate within the housing 154. The cylindrical cam includes cam means 176 (FIG. 4) which defines a forward cam face 178 and a rearward cam face 180. The configuration of the cam 176 and its forward and rear faces 178 and 180 respectively will be described in detail below.

The moveable core 160 includes a pair of cam followers indicated at 182 and 184 (FIG. 3). As will be appreciated, as the cylindrical cam 164 rotates within the housing 154, cam followers in contact with the forward and rearward face of the cam effect the reciprocal movement of the moveable core 160 on shaft members 162.

Figure 4:
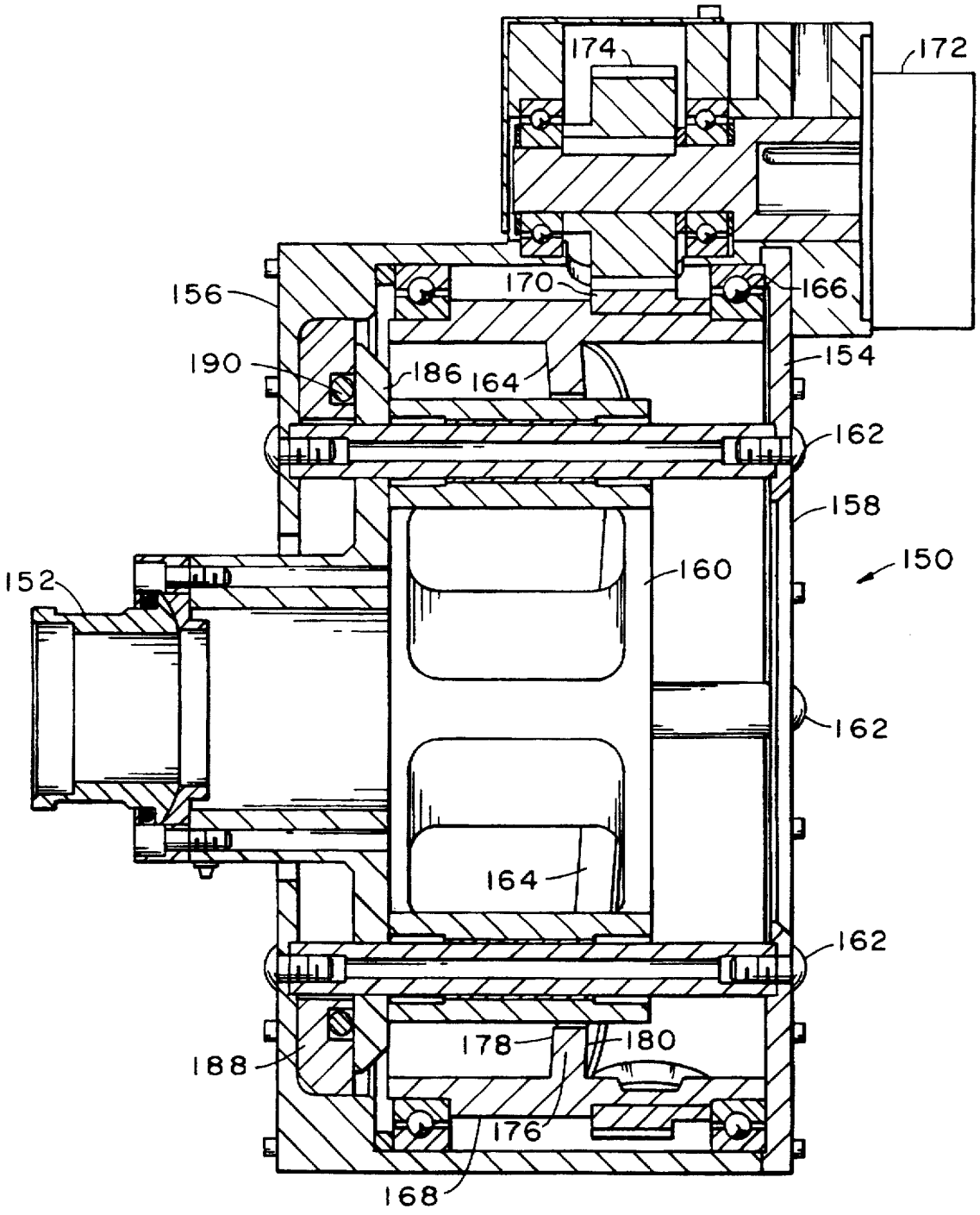
FIG. 4 is a view in section of the redraw system of the instant invention.

On the forward face 186 of the moveable member 160, there is mounted a steel core member 188 (FIGS. 3 and 4). The redraw sleeve 152 is mounted within a bore 146 defined by the steel core 186 by means well known in the art. This can be appreciated, the ram not shown in these figures also passes through the bore 146 and through the redraw sleeve 152.

The housing 160 forward face 186 includes a housing plate 188 fixedly supported within the housing and proximate the front face 186. The plate includes therein a channel 189 in which is disposed an electrical woven coil 190 (FIGS. 3 and 4 made of woven, electrically conductive material.). The coil 190 is in electrical communication with an appropriate power supply schematically represented at 192 for selective activation of the coil 190 to create a magnetic field.

Figure 5:
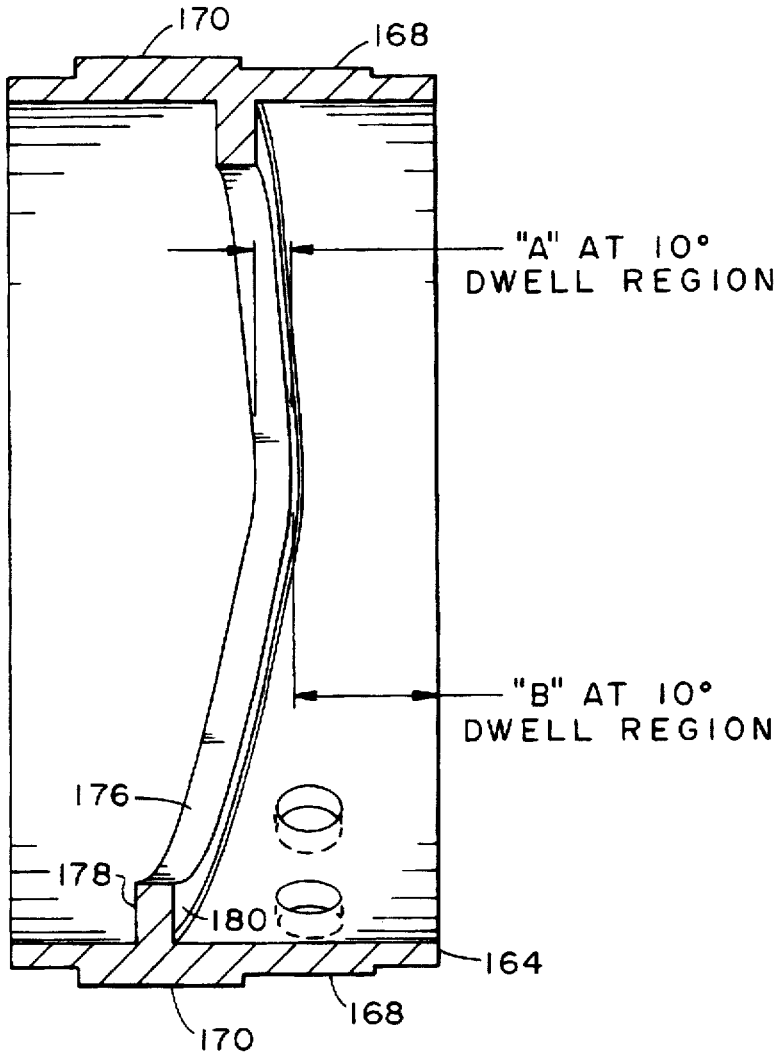
FIG. 5 is a view in section or the rotating cam mechanism of the redraw system of this invention.
Figure 6:
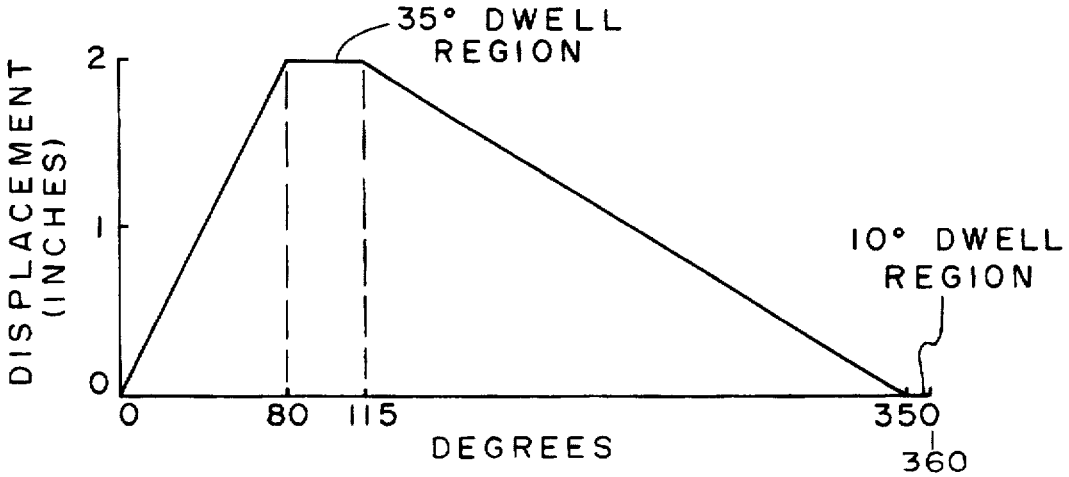
FIG. 6 is a graph plotting the displacement of the redraw system through a complete cycle of travel.

The cam means 176 has a forward face 178 and rearward face 180 which define a cam profile as illustrated by FIGS. 5 and 6. As the cam means rotates 360° the core 160 is reciprocated from its rearward most position, through a hold down period during the drawing and ironing process at its forward most position, and then back to its rearward most position. The forward travel takes place during the travel from 0° through 80° of can rotation. Cam face 178 is in contact with cam follower 182 driving the core forward to engage the cup preform. During a 35° dwell region, or first dwell period, an electromagnetic hold down force is activated, as will be described in detail below. The rearward face 180 of the cam follower is provided with clearance between it and the rear cam follower 184 so that there is no interference with the rear cam face as the electromagnetic force engages the central core, holding the redraw sleeve in its forward most position. The drawing and ironing process is completed during the first dwell period. As the cam means 164 continues its rotation through the next component of its travel, from approximately 115° through 350°, the core member disengages from the toolpack and travels rearwardly. The cam face 180 is in contact with the cam follower 184, driving the core rearwardly to a second, optional dwell period. An optional dwell period or second dwell can be provided from approximately 350° through 360°. This second dwell is consistent with the core being at a point distal the toolpack.

Control means 194 (FIG. 3) incorporating means for activating and deactivating the electromagnetic force generated by the coil 190 are in communication with a suitable power supply 192. The control means 194 ensures that the activation of hold down force takes place as the cup 82 is positioned for drawing and ironing. The hold down force must be maintained throughout the drawing and ironing process which occurs during the first dwell region of cam travel. Additionally, the control means 194 may be in electrical communication with the drive motor 172 for the cam in order to adjust the speed of the motor and therefore change the time required for the redraw sleeve movable housing to complete one cycle. For example, at speeds of approximately 400 strokes per minute, the redraw sleeve must engage, hold down, and release cups at a rate of 400 cups per minute.

By adjusting the cam timing, a single cycle of the redraw sleeve is coordinated with the stroke of the ram. It is contemplated that the cam can be modified to effect two cycles of the redraw sleeve for each rotation of the cam cylinder. Additionally, the optional second dwell period can be eliminated.

The present invention has been described in an illustrative manner. It is to be understood that the terminology which has been used is intended to be in the nature of words of descriptive rather than limitation. Many modifications and variations of the preset invention are possible in light of the above teachings. Therefore within the scope of the appended claims, the present invention may be practiced otherwise than as specifically described.

What is claimed is:

1. An redraw apparatus for a can body maker comprising:

a redraw housing means adapted to be fixedly mounted onto the body maker, said redraw housing having a forward face and a rearward face, said forward face including means susceptible to magnetic influence;

a core means mounted for reciprocal motion within said redraw housing means, said core means including cam followers;

cam means mounted in said redraw housing means and operatively engaged with said cam followers whereby movement of said cam means effects said core means reciprocal movement; and electromagnetic means mounted in the forward face of said redraw housing means, whereby the electromagnetic means is selectively activated to provide hold down force to said core means.

2. The redraw apparatus according to claim 1 wherein the core means includes means for receiving thereon a redraw sleeve on the forward face thereof.

3. The redraw apparatus according to claim 1 wherein the cam means is mounted for rotational movement within the redraw housing means.

4. The redraw apparatus according to claim 1 wherein the cam means is mounted for rotational movement with the redraw housing means and includes a cam cylinder with an outer surface and an inner surface, and said inner surface includes a cam member projecting radially inward therefrom.

5. The redraw apparatus according to claim 4 wherein the cam member includes a first cam face and a second cam face.

6. The redraw apparatus according to claim 5 wherein the core means cam followers are a first, forward cam follower, and a second rearward cam follower, and said forward cam follower engages the first face of the cam means and the second cam follower engages the second face of the cam means.

7. The redraw apparatus according to claim 6 wherein the cam means' rotational movement effects the reciprocal movement of the core means from a forward position proximate a toolpack to a rearward position distal the toolpack.

8. The redraw apparatus according to claim 7 wherein the cam means defines at least a first dwell cycle during which the second cam face is in a spatial relation with respect to the second cam follower so that as the core means is engages by the electromagnetic means, said core means forward travel is unimpeded by contact of said second follower with said second cam face.

9. The redraw apparatus according to claim 5 wherein the cam first face is in contact with the first cam follower during an initial portion of the cam profile as defined by the complete rotation of the cam cylinder.

10. The redraw apparatus according to claim 9 whereas complete rotation of the cam cylinder represents a 360° cycle and the first cam follower is engaged for approximately 80°.

11. The redraw apparatus according to claim 9 wherein the cam second face is in contact with the second cam follower during a subsequent portion of the cam profile, said subsequent portion running from approximately 115° to 150°.

12. The redraw apparatus according to claim 9 wherein the cam second face is in a spatial relation with the second cam follower during a dwell cycle during which electromagnetic force is applied to the core member.

13. The redraw apparatus according to claim 1 wherein the cam means is mounted for rotational movement within the core means and includes a cam cylinder outer surface, and wherein the redraw housing means includes a motion means in mechanical communication with the cam cylinder outer surface to effect the rotation of the cam cylinder within the housing.

14. In combination with a can body maker, a redraw apparatus comprising:

a redraw housing means adapted to be fixedly mounted onto the body maker, said redraw housing having a forward face and a rearward face, said forward face including means susceptible to magnetic influence;

a core means mounted for reciprocal motion within said redraw housing means, said core means including cam followers;

cam means mounted in said redraw housing means and operatively engaged with said cam followers whereby movement of said cam means effects said core means reciprocal movement; and electromagnetic means mounted in the forward face of said redraw housing means, whereby the electromagnetic means is selectively activated to provide hold down force to said core means.

15. The combination according to claim 14 wherein the core means includes means for receiving thereon a redraw sleeve on the forward face thereof.

16. The combination according to claim 14 wherein the cam means is mounted for rotational movement within the redraw housing means.

17. The combination according to claim 14 wherein the cam means is mounted for rotational movement with the redraw housing means and includes a cam cylinder with an outer surface and an inner surface, and said inner surface includes a cam member projecting radially inward therefrom.

18. The combination according to claim 17 wherein the cam member includes a first cam face and a second cam face.

19. The combination according to claim 18 wherein the core means cam followers are a first, forward cam follower, and a second rearward cam follower, and said forward cam follower engages the first face of the cam means and the second cam follower engages the second face of the cam means.

20. The combination according to claim 14 wherein the cam means is mounted for rotational movement within the core means and includes a cam cylinder outer surface, and wherein the redraw housing means includes a motion means in mechanical communication with the cam cylinder outer surface to effect the rotation of the cam cylinder within the housing.

* * * * *